US008421807B2

(12) United States Patent
Yamashita

(10) Patent No.: US 8,421,807 B2
(45) Date of Patent: Apr. 16, 2013

(54) DISPLAY DEVICE

(75) Inventor: Keitaro Yamashita, Hyogo (JP)

(73) Assignee: Chimei Innolux Corporation, Zhunan Township, Miaoli county (TW)

( * ) Notice: Subject to any disclaimer, the term of this patent is extended or adjusted under 35 U.S.C. 154(b) by 370 days.

(21) Appl. No.: 12/793,327

(22) Filed: Jun. 3, 2010

(65) Prior Publication Data

US 2011/0298784 A1 Dec. 8, 2011

(51) Int. Cl.
*G09F 15/00* (2006.01)
*G09G 3/36* (2006.01)

(52) U.S. Cl.
USPC ..... 345/501; 345/98

(58) Field of Classification Search ..... 345/98, 345/501; 365/222
See application file for complete search history.

(56) References Cited

U.S. PATENT DOCUMENTS

| | | | | |
|---|---|---|---|---|
| 5,945,972 | A * | 8/1999 | Okumura et al. | 345/98 |
| 2008/0025122 | A1 * | 1/2008 | Schakel et al. | 365/222 |
| 2008/0143729 | A1 * | 6/2008 | Wyatt et al. | 345/501 |

* cited by examiner

*Primary Examiner* — Kevin M Nguyen
(74) *Attorney, Agent, or Firm* — Muncy, Geissler, Olds & Lowe, PLLC

(57) ABSTRACT

A display device includes a display unit and a plurality of refreshing units. The display unit has a plurality of the display areas. Each of the display areas has a plurality of pixels. Each of the pixels has a memory. The refreshing units respectively control to refresh the pixels of the corresponding display areas at different time periods. Thus, the produced peak current during the pixel refreshing can be reduced, and the stored pixel data can be maintained.

10 Claims, 7 Drawing Sheets

DISPLAY DEVICE

BACKGROUND OF THE INVENTION

1. Field of Invention

The present invention relates to a display device.

2. Related Art

Since the liquid crystal display (LCD) device has the advantages, such as thinner, lighter, lower power consumption, less radiation, compatible with semiconductor manufacturing processes, etc., it is widely applied in various electronic products. Consequently, it is highly required to provide better technology and functions thereof.

The liquid crystal molecule has a special character that is the liquid crystal molecule can not be operated under a specific voltage for a long time. If the liquid crystal molecule is operated under a specific voltage for a long time, even the applied voltage is removed, the character of the liquid crystal molecule can be destroyed and the liquid crystal molecule may not be rotated based on the applied electric field. Thus, the LCD panel can not display the desired gray level, and may have image sticking. Accordingly, the applied voltage must be changed every period of time so as to protect the character of the liquid crystal molecules. This can be done by applying a periodic voltage alternation to the pixels from an external driving circuit for rotating the liquid crystal molecules.

In order to improve the power consumption for continuously applying the pixel data of two polarities, the pixel of the LCD device may have a build-in memory for recording the pixel data. However, when the pixel and the memory thereof are refreshed, the steep peak current and voltage bounce may occur in the related connecting lines. This may endanger the memories. More serious, the steep peak current and voltage bounce may affect the charging/discharging time and voltage of the pixel capacitor, which may cause the loss of the pixel data.

Therefore, it is an important subjective of the present invention to provide a display device that has decreased power consumption of the panel and better stability of the memories.

SUMMARY OF THE INVENTION

In view of the foregoing subjective, an object of the present invention is to provide a display device that can decrease the power consumption of the panel as well as the peak current caused by the refreshing of the pixel memories, thereby maintaining the pixel data of the display device.

The display device according to the present invention includes a display unit and a plurality of refreshing units. The display unit includes a plurality of display areas, and each display area has a plurality of pixels, each of which has at least one memory. The refreshing units respectively control to refresh the memories of the pixels of the corresponding display areas at different time points.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 1:
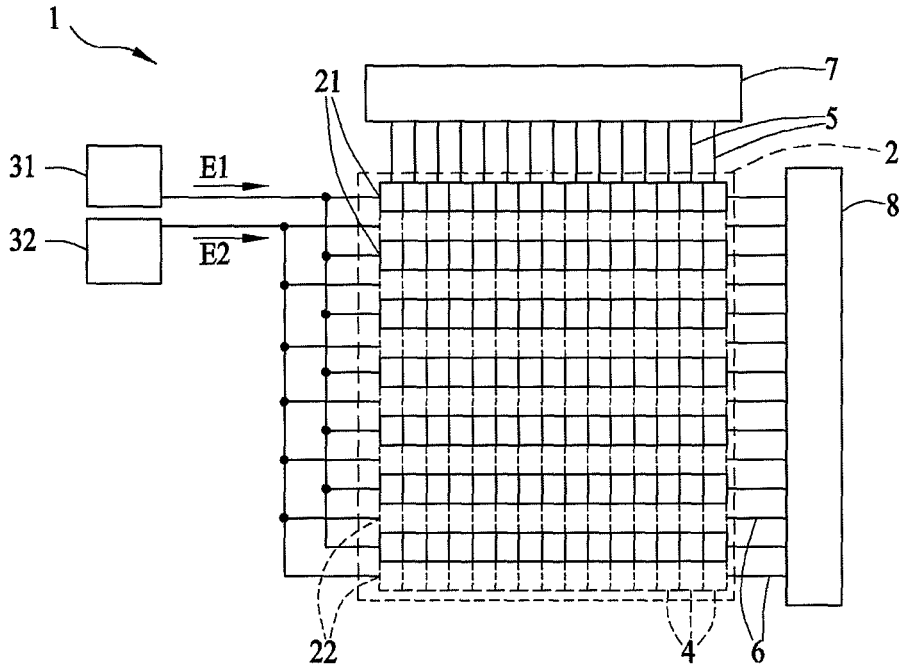
FIG. 1 is a schematic diagram showing a display device according to a preferred embodiment of the present invention.

FIG. 1 is a schematic diagram showing a display device according to an embodiment of the present invention. With reference to FIG. 1, a display device 1 includes a display unit 2 and a plurality of refreshing units 31 and 32. The display unit 2 includes a plurality of display areas 21 and 22, and each of the display areas 21 and 22 has a plurality of pixels 4. Each pixel 4 includes at least one memory.

The pixel 4 is the basic unit for displaying images, and may display red, blue, green, or white. The memory of the pixel 4 can record the data displayed by the pixel 4, and it can be a discrete component such as a volatile memory (e.g. a dynamic random access memory (DRAM) or static random access memory (SRAM)). The data stored in the memory can be accessed in a digital way.

The display areas 21 and 22 are divided into at least two groups for refreshing the corresponding pixels and their memories, so that the pixels and their memories that are located at different display areas can be refreshed at different time points. Consequently, the ripples of the related lines caused by the pixel refreshing can be distributed to different time points, and the ripple generated at a certain time point can be minimized.

In this embodiment, the display areas 21 and 22 are, for example, divided into a first display area group 21 and a second display area group 22. The display areas of the first display area group 21 and the display areas of the second display area group 22 are, for example but not limited to, interlacedly arranged.

The refreshing units 31 and 32 respectively output at least one refresh signal set E1 and at least one refresh signal set E2 to the corresponding display areas 21 and 22 at different time points. For example, each of the refresh signal set E1 and E2 includes a memory sampling signal and a memory refresh signal. The memory sampling signal can control the memory of the pixel to sample the liquid crystal storage capacitor of the pixel, and the refresh signal can control to refresh the memory of the pixel. The detailed description will be illustrated hereinafter.

If the present invention is applied to a liquid crystal display device, the display device 1 may further include a plurality of column lines 5, a plurality of row lines 6, a column drive unit 7 and a row drive unit 8. The column lines 5 and the row lines 6 are coupled with the pixels 4 of the display areas 21 and 22. The column drive unit 7 is coupled with the column lines 5, and is coupled with the pixels 4 of the display areas 21 and 22 through the column lines 5. The row drive unit 8 is coupled with the row lines 6, and is coupled with the pixels 4 of the display areas 21 and 22 through the row lines 6.

The row drive unit 8 can control the time sequence of data writing into the pixels 4 through the row lines 6, and the column drive unit 7 can control to write pixel data into the pixels 4 through the column lines 5. The written pixel data can be stored in the memories or storage capacitors of the pixels 4. In the embodiment, the column drive unit 7 and the row drive unit 8 can be a data driver and a scan driver, respectively, and the column lines 5 and the row lines 6 can be data lines and scan lines, respectively.

The display device 1 may have two display modes. In the first mode, a normal display mode, the column drive unit 7 periodically writes pixel data, which includes the control information of the liquid crystal polarity reversal, into the storage capacitor of the pixel 4. In other words, the gray level to be displayed by the pixel 4 is stored in the storage capacitor, and the storage capacitor is controlled by the column drive unit 7. However, in this normal display mode, at lease one part of the drive circuit, e.g. the column drive unit 7 or timing control unit, must record the pixel data to be displayed by the pixel 4, so that the column drive unit 7 can continuously write the pixel data into the pixel 4.

The second mode is a build-in memory display mode. In this display mode, the gray level to be displayed by the pixel 4 is recorded in the memory configured inside the pixel 4, and the voltage level of the storage capacitor of the pixel 4 is controlled by the memory rather than the column drive unit 7. In this case, it is not necessary to continuously write the pixel data by the column drive unit 7, but to periodically refresh the memory. Thus, this build-in memory display mode has less power consumption, so that it is suitable for the application with low power consumption. To be noted, under the build-in memory display mode, the pixel voltage of the LCD device still has to be changed periodically by applying a periodic voltage alternation, so that the image sticking of the display areas can be prevented. The periodic voltage alternation can be achieved without writing new data from the column lines 5. The pixel 4 can periodically perform the refreshing operation so as to decrease the operation frequency of the timing drive circuit of the external drive unit, so that the power consumption of the timing drive circuit can be efficiently minimized.

Figure 2:
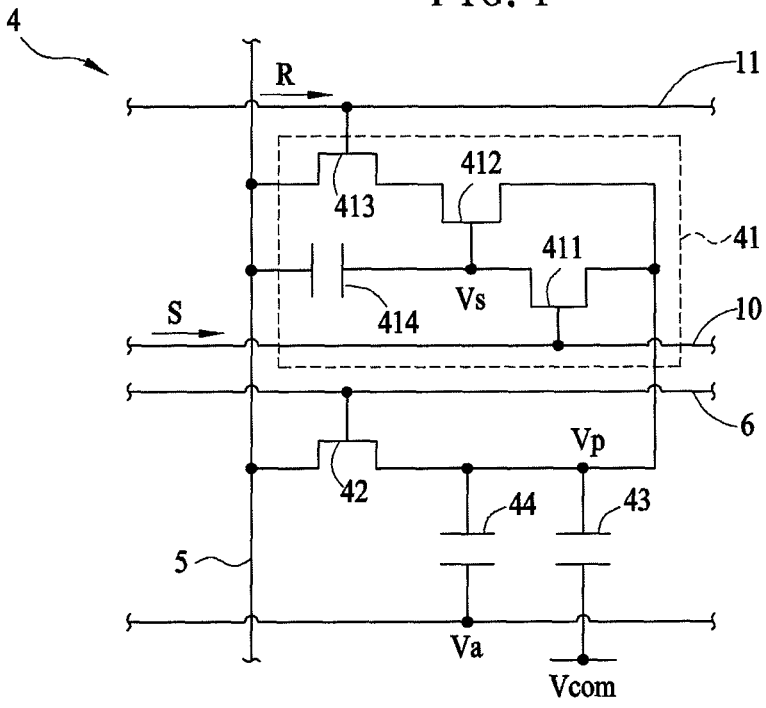
FIG. 2 is a circuit diagram of a pixel of FIG. 1.

FIG. 2 is a circuit diagram of the pixel 4 shown in FIG. 1. The memory 41 of the pixel is, for example, a DRAM, and the refreshing unit can perform the refreshing of the memory of the pixel through the sampling line 10 and the refreshing line 11.

In this embodiment, the pixel 4 includes a memory 41, a switch 42, a liquid crystal storage capacitor 43, and an auxiliary storage capacitor 44. The switch 42 is a transistor, the liquid crystal storage capacitor 43 is composed of a pixel electrode and a common electrode Vcom, and the auxiliary storage capacitor 44 is composed of the pixel electrode and an auxiliary electrode Va. The common electrode Vcom and the auxiliary electrode Va usually have the same voltage level. The auxiliary storage capacitor 44 can assist the liquid crystal storage capacitor 43 to enhance the data storage ability, and is not essential in the pixel 4. In the normal display mode, the row drive unit 8 can control to turn on or off the switch 42 through the row line 6, thereby controlling the time sequence for writing data into the pixel 4. When the switch 42 is turned on, the column drive unit 7 can write pixel data into the liquid crystal storage capacitor 43 and the auxiliary storage capacitor 44 of the pixel 4 through the column line 5.

In the build-in memory display mode, the memory 41 must be refreshed to continuously record the data.

The memory 41 includes switches 411, 412 and 413, and a capacitor 414. In this case, the switches 411, 412 and 413 are all transistors.

The capacitor 414 is connected between the column line 5 and a node Vs, and the switch 411 is connected between the node Vs and the liquid crystal storage capacitor 43, so that the refreshing unit can control to turn on or off the switch 411 through the sampling line 10. The switch 413 is connected between the switch 412 and the column line 5, so that the refreshing unit can control to turn on or off the switch 413 through the refreshing line 11. The switch 412 is connected between the switch 413 and the liquid crystal storage capacitor 43, so that the node Vs can control to turn on or off the switch 412. When the switch 413 is turned on, the switch 412 can decide whether to discharge the liquid crystal storage capacitor 43, and the column drive unit 7 controls the voltage level of the column line 5 to be 0 volt in the meantime.

Figure 3:
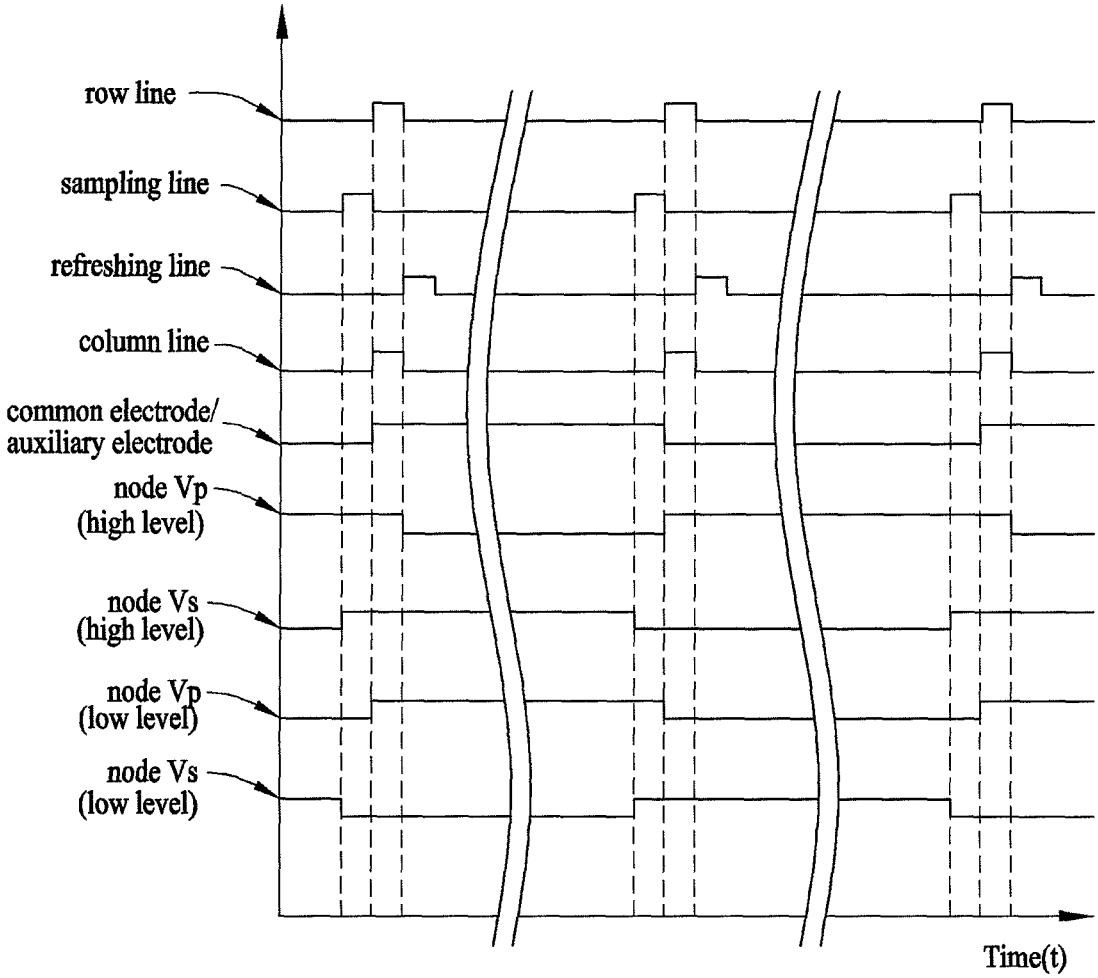
FIG. 3 is a schematic graph showing waveforms during the pixel refreshing of the invention.

The pixel refreshing will be described hereinbelow with reference to FIG. 3, which is a schematic graph showing waveforms during the pixel refreshing of the invention.

First, the refreshing unit outputs a memory sampling signal S to the sampling line 10 so as to turn on the switch 411, so that the voltage level of the node Vs can be equal to that of the pixel electrode. In FIG. 2, the voltage of the pixel electrode can be represented by the voltage of the node Vp.

Next, the refreshing unit controls to turn off the switch 411, so that the column drive unit 7 and the row drive unit 8 respectively output high level signals to the column line 5 and the row line 6. Meanwhile, the row drive unit 8 controls to turn on the switch 42, so that the high level signal outputted from the column drive unit 7 can be written into the liquid crystal storage capacitor 43 to be the pixel voltage.

Then, the refreshing unit outputs a memory refresh signal R to the refreshing line 11 for turning on the switch 413, so that the column drive unit 7 can control the voltage of the column line 5 to be equal to 0 volt. Meanwhile, if the voltage of the node Vs can control to turn on the switch 412, the liquid crystal storage capacitor 43 is discharged through the column line 5, so that the voltage of the node Vp can be decreased to 0 volt or lower.

Regarding to a normally-black LCD device, the voltage of the node Vp can be alternated between a negative voltage and a positive voltage (e.g. −5V to 5 V, or 5V to −5V) during the periods before and after the pixel refreshing of a lighting pixel according to the above-mentioned mechanism. In addition, the voltage of the node Vp can be maintained at a low voltage level (e.g. 0V) during the periods before and after the pixel refreshing of a black pixel. That is, the voltage of the node Vp is remained the same before and after the pixel refreshing. The pixel refreshing mechanism can not only efficiently record the pixel data, but also protect the character of polarity reversal of the liquid crystal.

In other words, the pixel refreshing process can not only refresh the memory, but also can perform the polarity reversal of the liquid crystal storage capacitor.

The refreshing process of the pixel and its memory can be summarized as the following steps of: controlling the memory by the memory sampling signal to sample the liquid crystal storage capacitor, performing a polarity reversal by the liquid crystal storage capacitor, and controlling by the refreshing signal to refresh the memory. When performing the pixel refreshing, the column drive unit and the row drive unit can control the liquid crystal capacitor of the corresponding pixel to perform the desired polarity reversal respectively through the column line and row line.

However, the column line 5 still has a slight thin film resistance, so that this thin film resistance can resist the voltage of the node Vp as the memory is refreshed. This can induce the memory of the pixel to generate the voltage bounce. If all pixels 4, which are connected to the same column line 5, perform the pixel refreshing simultaneously, the serious voltage bounce may occur, which can result in the malfunction of the memory and, moreover, the loss of the data stored in the memory.

In order to improve this problem, the pixels 4 connected to the same column line 5 are divided into two groups. In other words, each of the display areas 21 and 22 as shown in FIG. 1 is divided into at least two groups for the refreshing process of the pixels and their memories.

Figure 4:
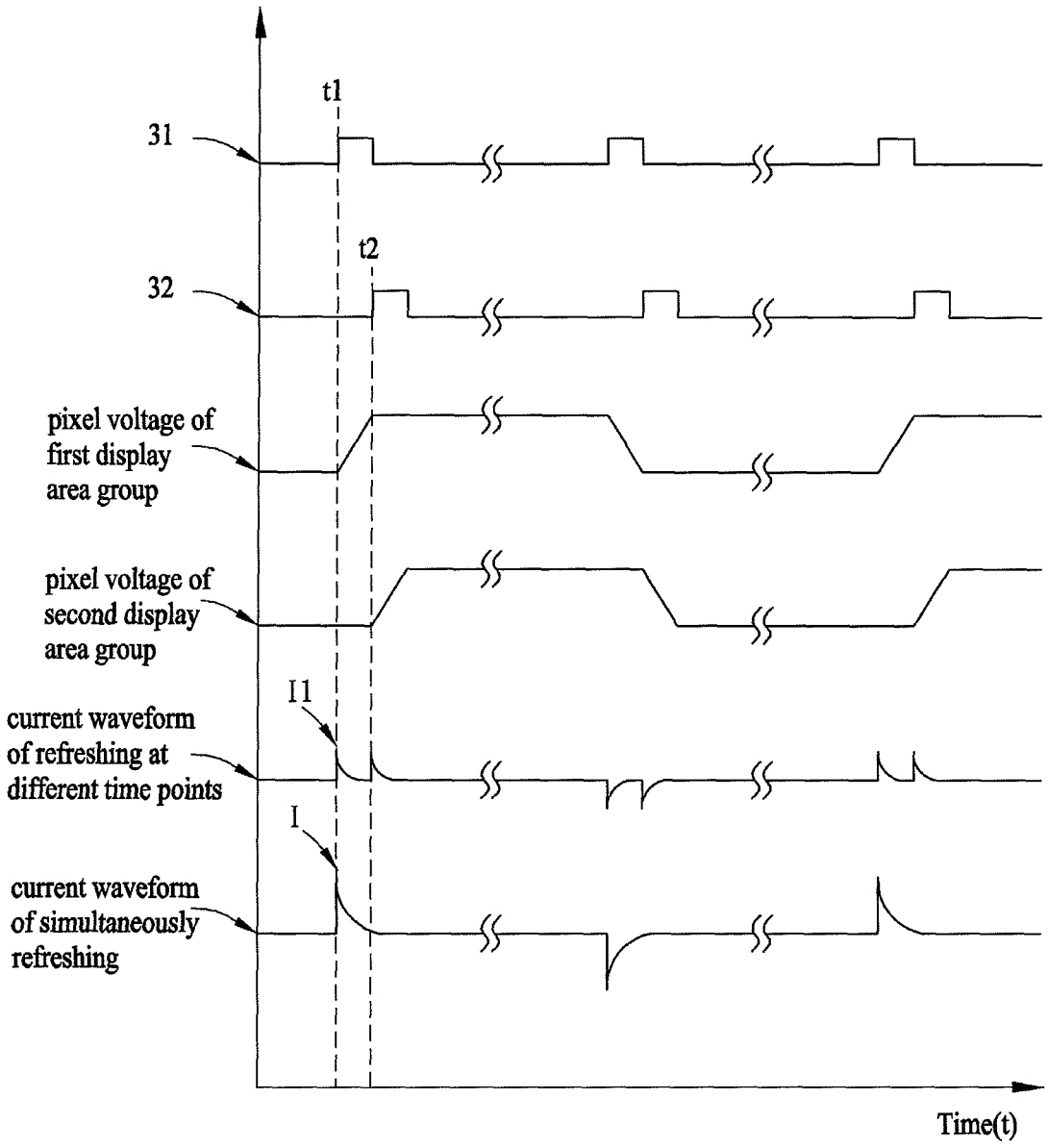
FIG. 4 is a schematic graph showing waveforms retrieved from the display device of FIG. 1.

FIG. 4 is a schematic graph showing waveforms retrieved from the display device of FIG. 1. As shown in FIG. 4, at a first time point t1, the refreshing unit 31 outputs a refresh signal set E1 to the memories 41 of the pixels 4 in the first display area group 21 so as to refresh the memories 41 of the related pixels 4. During this refreshing process, the column line 5 of the display device 1 generates a peak current I1, which is smaller than the peak current I generated at the circumstance of simultaneously refreshing all pixels.

After refreshing the pixels in the first display area group 21, the refreshing unit 31 stops outputting the refresh signal set E1, and then the refreshing unit 32 outputs a refresh signal set E2 to the memories 41 of the pixels 4 in the second display area group 22 at a second time point t2 so as to refresh the memories 41 of the related pixels 4. During this refreshing process, the column line 5 of the display device 1 also generates a peak current I1.

Since the memory refreshing of the first display area group 21 and the second display area group 22 are performed at different time points, the generated peak current I1 can be greatly decreased. Each of the refresh signal sets E1 and E2 includes a sampling signal S and a refreshing signal R, and the detailed refreshing process of the pixels is described in the above embodiment with reference to FIGS. 2 and 3, so the detail description thereof will be omitted.

Since the pixels and their memories of different display areas are refreshed at different time points, the peak current and voltage bounce caused by the pixel refreshing on the column lines 5 can be distributed to different time points. Thus, the voltage bounce and peak current induced on the column line 5 at a certain time point can be reduced, so that the loss of the data stored in the pixels 4 can be prevented.

In addition, the memory of the pixel can be a SRAM rather than a DRAM.

Figure 5:
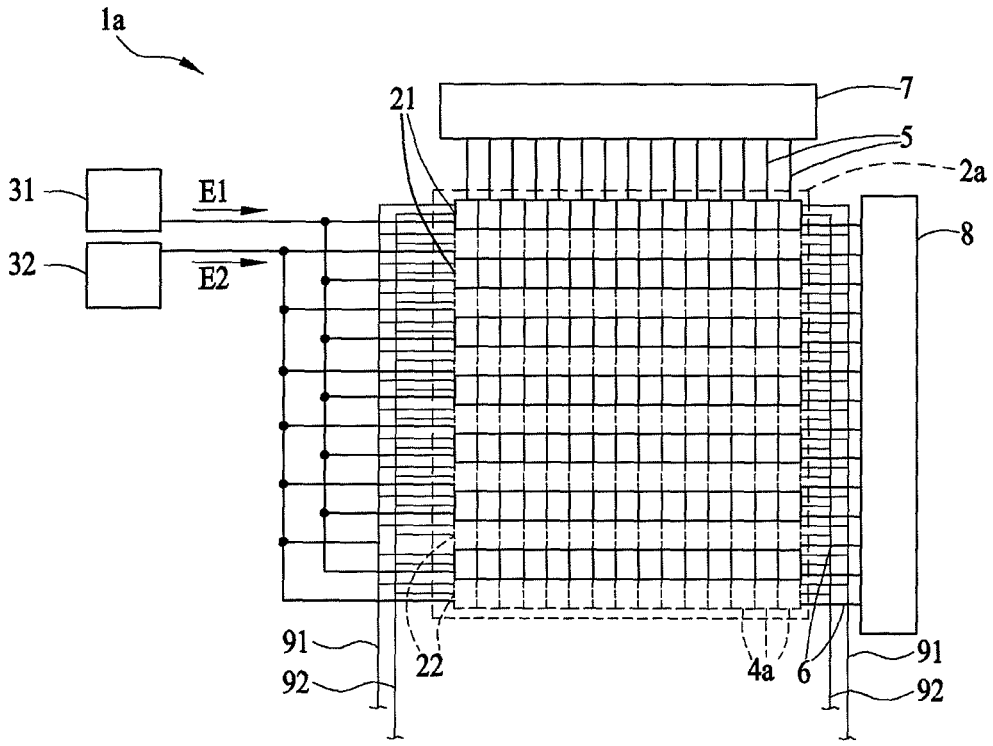
FIG. 5 is a schematic diagram showing a display device according to another embodiment of the present invention.

FIG. 5 is a schematic diagram showing a display device according to another embodiment of the present invention. Different from the embodiment shown in FIG. 1, the memories of the pixels 4*a* of FIG. 5 are SRAMs, and the display device 1*a* of FIG. 5 further includes two power lines 91 and 92, which are both coupled with the pixels 4*a*.

When the refreshing units 31 and 32 respectively output the refresh signal sets E1 and E2 to the memories of the corresponding pixels 4*a* in the display areas 21 and 22, the current can be applied to the pixels 4*a* in the display areas 21 and 22 through the power lines 91 and 92.

Figure 6:
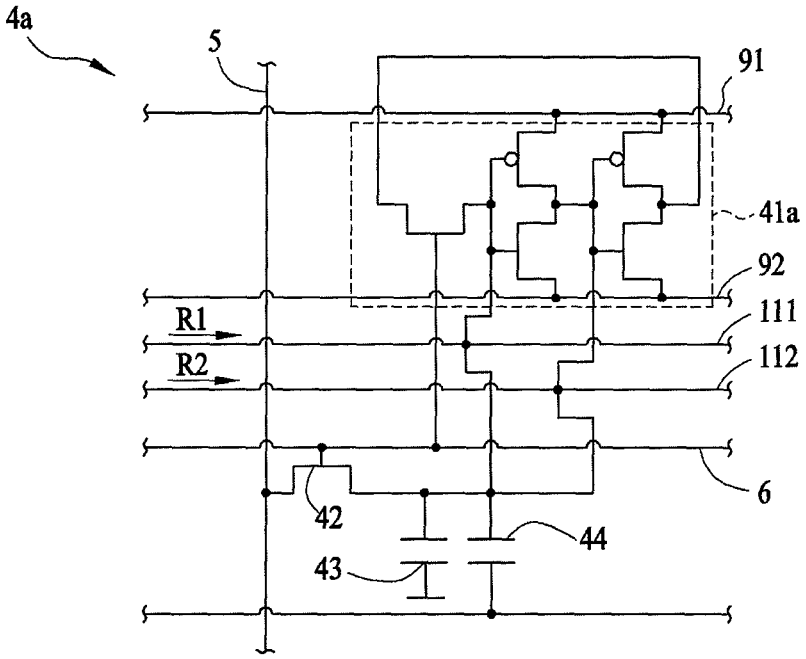
FIG. 6 is a circuit diagram of a pixel of FIG. 5.

FIG. 6 is a circuit diagram showing a pixel 4*a* of the display unit 2*a* as shown in FIG. 5, and the memory of the pixel 4*a* is, for example, a SRAM.

The memory 41*a* includes two inverters, each of which is composed of a plurality of transistors, and two power lines 91 and 92 are disposed at opposite sides of the memory 41*a*, respectively. Then, the input and output of one of the inverters are respectively connected to the output and input of the other one of the inverters so as to form a latch, so that the memory 41*a* can successfully remain the stored data. The power lines 91 and 92 are connected to the inverters for providing power to the inverters. When refreshing the pixel 4*a* and its memory 41*a*, the polarity reversal of the pixel electrode in the storage capacitor of the pixel 4*a* may induce the peak current in the power lines 91 and 92. To be noted, the memory 41*a* of this embodiment is a SRAM, so that the pixel capacitor can be charged or discharged through the power lines 91 and 92, thereby inducing the peak current in the power lines 91 and 92.

In addition, two memory refresh signals R1 and R2 can be transmitted to the two transistors respectively through two refreshing lines 111 and 112, so that the transistors can control the refreshing of the memories 41*a* of the corresponding pixels 4*a*. Memory refresh signal R2 controls the pixel capacitor to be discharged through the inverter and the power line 92, or to be charged through the inverter and the power line 91. Memory refresh signal R1 controls the memory 41*a* to change the logic state of the inverters of the memory 41*a* by connecting the pixel capacitor with the memory 41*a*. To be noted, the refreshing lines 111 and 112 may not transmit the memory refresh signals R1 and R2 at the same time. For example, the pixel 4*a* may transmit the memory refresh signal R2 to the memory 41*a* of the pixel 4*a*, and then transmit the memory refresh signal R1 to the memory 41*a* of the pixel 4*a* so as to refresh the memory 41*a* of the pixel 4*a*.

Since the pixels of different display areas are refreshed at different time points, the peak current and voltage bounce caused by the refreshing of the pixels and their memories on the power lines 91 and 92 can be distributed to different time points. Thus, the voltage bounce and peak current induced on the power lines 91 and 92 at a certain time point can be reduced, so that the loss of the data stored in the pixels 4*a* can be prevented.

Since the time sequence for controlling the refreshing of the pixels 4*a* in different display areas is the same of those described with reference to FIG. 4, the detailed description thereof will be omitted.

Figure 7:
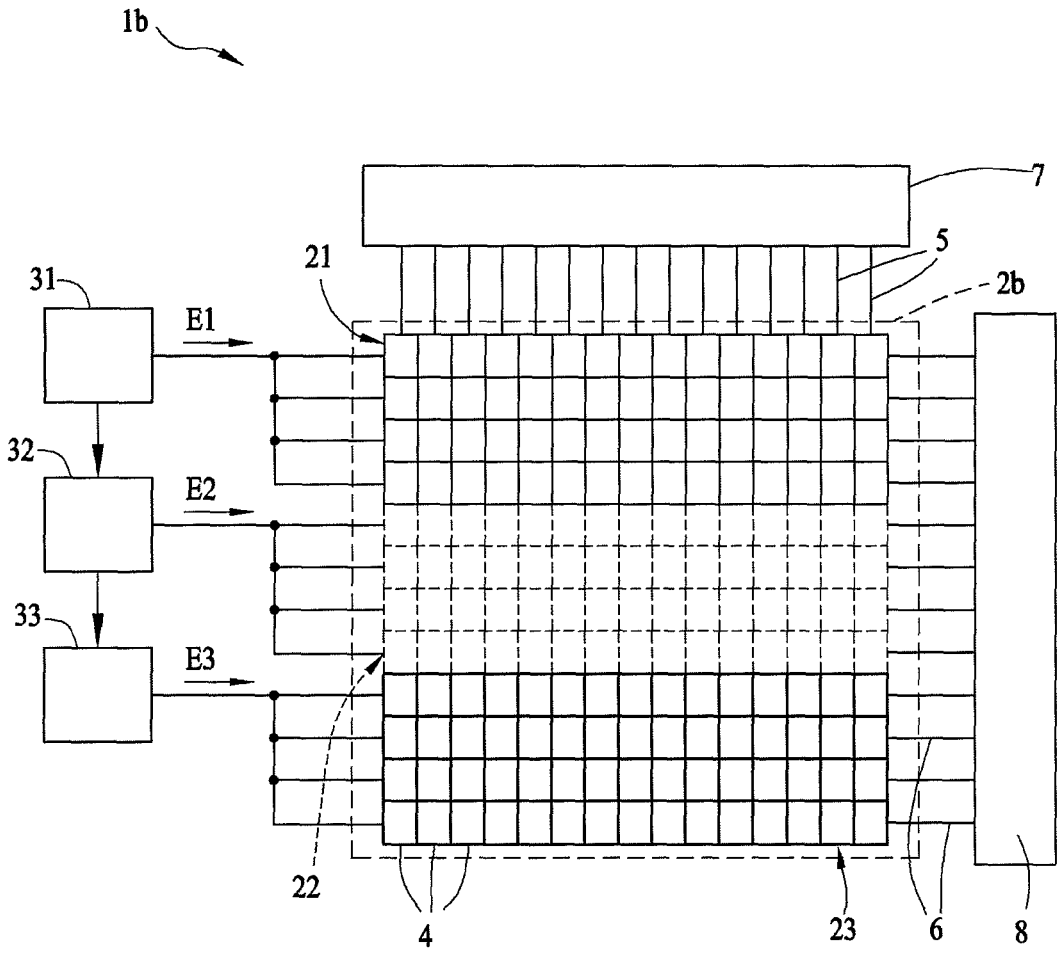
FIG. 7 is a schematic diagram showing a display device according to yet another preferred embodiment of the present invention.

FIG. 7 is a schematic diagram showing a display device 1*b* according to yet another embodiment of the present invention. In this embodiment, the display area 1*b* includes a plurality of refreshing units 31, 32 and 33. To be noted, the number of the refreshing units can be determined depending on the circuit design and refreshing time of the display device.

For example, the display unit 2*b* of the present embodiment includes a first display area group 21, a second display area group 22, and a third display area group 23. The first, second and third display area groups 21, 22 and 23 are arranged in order, and each of them includes a plurality of pixels 4. The refreshing units 31, 32 and 33 can respectively output at least the refresh signal sets E1, E2 and E3 to the memories of the corresponding pixels 4 in the display areas 21, 22 and 23.

Figure 8:
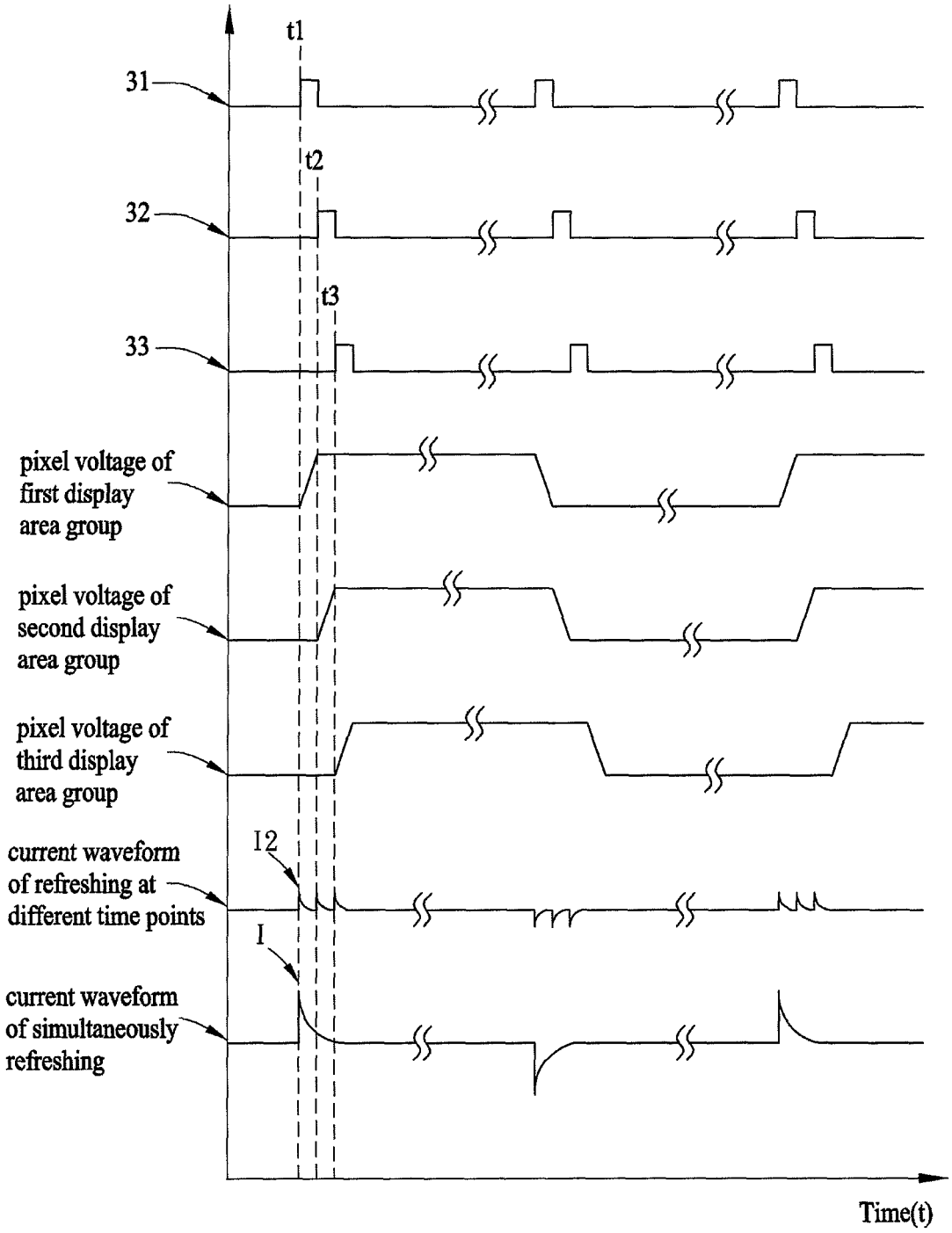
FIG. 8 is a schematic graph showing waveforms retrieved from the display device of FIG. 7.

The time sequences of the signals outputted from the refreshing units 31, 32 and 33 are shown in FIG. 8, so that the refreshing units 31, 32 and 33 respectively output the refresh signal sets E1, E2 and E3 to the corresponding display areas in order.

At a first time point t1, the refreshing unit 31 outputs the refresh signal set E1 to the first display area group 21, which induces a peak current I2 on the column line 5. At a second time point t2, the refreshing unit 32 outputs the refresh signal set E2 to the second display area group 22, which induces another peak current I2 on the column line 5. At a third time point t3, the refreshing unit 33 outputs the refresh signal set E3 to the third display area group 23, which induces still another peak current I2 on the column line 5.

In the present embodiment, the refresh signal sets E1, E2 and E3 are respectively transmitted to the first, second and third display area groups 21, 22 and 23 at different time points, so that the induced peak currents I2 are greatly smaller than the peak current I generated in the circumstance of simultaneously refreshing all pixels. In addition, the memories of the display areas 21, 22 and 23 are refreshed at different time points, so that the steep peak current caused by the pixel refreshing of the prior art can be efficiently distributed into smaller ones.

Figure 9:
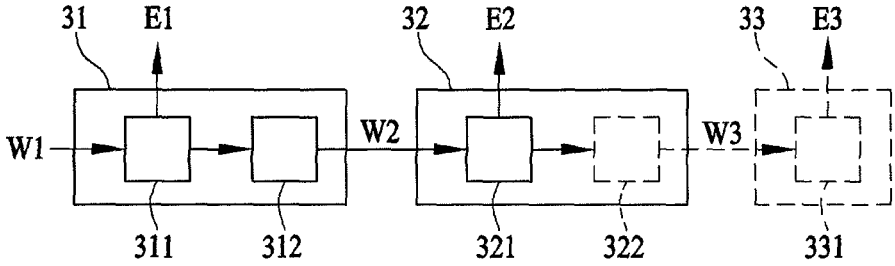
FIG. 9 is a schematic diagram showing a refreshing unit according to the preferred embodiment of the present invention.

FIG. 9 is a schematic diagram showing a refreshing unit according to the embodiment of the present invention. As shown in FIG. 9, the refreshing unit 31 includes a buffer circuit 311 and a delay circuit 312, and the refreshing unit 32 includes a buffer circuit 321. In this embodiment, each of the buffer circuits 311 and 321 is a shift register or a passive component.

The buffer circuit 311 can output a refresh signal set E1 to the memories of the pixels in the corresponding display area according to a control signal W1. The delay circuit 312 can delay the control signal W1, and then output the delayed control signal W2 to the refreshing unit 32. Then, the buffer circuit 321 of the refreshing unit 32 can output the refresh signal set E2 to the memories of the pixels in the corresponding display area according to the delayed control signal W2.

In addition, if the refreshing unit 32 further connects to a following refreshing unit 33, the refreshing unit 32 may further include a delay circuit 322 with the function similar to the delay circuit 312. Thus, the delay circuit 322 can delay the received control signal W2, and then output the delayed control signal W3 to another refreshing unit 33. The refreshing unit 33 includes a buffer circuit 331, which can output the refresh signal set E3 to the pixels in the corresponding display area according to the delayed control signal W3. Consequently, the refreshing units can output the refresh signal sets, respectively, at different time points.

The display device of the previous embodiments can be a dual-mode display device which has a transmissive display mode and a reflective display mode. Under the transmissive display mode, the memories of the pixels do not work, and the column drive unit cooperates with the row drive unit to write the pixel data into the pixel capacitor. Under the reflective display mode, the memories of the pixels can be periodically refresh as mentioned above to record the pixel data, and the column drive unit does not write new pixel data into the pixels.

In summary, the display device of the present invention has a plurality of refreshing units for controlling to refresh the corresponding pixels of several display areas. For example, the pixels of the first display area group are refreshed at the first time point, and the pixels of the second display area group are refreshed at the second time point, which is different from the first time point. Thus, the memories of the pixels in the display areas can be refreshed at different time points, so that the peak current and voltage bounce of the related connecting lines caused by the pixel refreshing can occur at different time points. Accordingly, at a certain time point, the total voltage bounce and the generated peak current of the connecting line can be reduced, and the data stored in the pixels can be maintained.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A display device, comprising:

a display unit comprising a plurality of display areas, wherein each of the display areas has a plurality of pixels, and each of the pixels has at least one memory; and a plurality of refreshing units for respectively controlling to refresh the pixels of the corresponding display areas at different time points, wherein the refreshing units separately output a refresh signal set to the pixels of the corresponding display areas, and the refresh signal set comprises a memory sampling signal and a memory refresh signal, wherein the memory sampling signal is outputted during a first interval, the memory refresh signal is outputted during a second interval, and the first interval and the second interval are separated.

2. The display device according to claim 1, wherein each of the pixels comprises a liquid crystal storage capacitor, the memory sampling signal controls the memory to sample the liquid crystal storage capacitor, and the memory refresh signal controls to refresh the memory.

3. The display device according to claim 2, further comprising:

a plurality of column lines coupled with the pixels of the display areas;

a plurality of row lines coupled with the pixels of the display areas;

a column drive unit coupled with the column lines; and a row drive unit coupled with the row lines, wherein when the pixels are refreshed, the column drive unit and the row drive unit control the liquid crystal storage capacitors of the corresponding pixels to perform a polarity reversal respectively through the column lines and the row lines.

4. The display device according to claim 1, wherein the memories are dynamic random access memories (DRAM) or static random access memories (SRAM).

5. The display device according to claim 1, wherein the display areas are divided into a first display area group and a second display area group, and the refreshing units control to refresh the pixels of the first display area group at a first time point, and to refresh the pixels of the second display area group at a second time point.

6. The display device according to claim 5, wherein the display areas of the first display area group and the display areas of the second display area group are interlacedly arranged.

7. The display device according to claim 1, wherein each of the refreshing units comprises:

a buffer circuit outputting a refresh signal set to the corresponding pixel according to a control signal.

8. The display device according to claim 7, wherein the buffer circuit is a shift register or a passive component.

9. The display device according to claim 7, wherein one of the refreshing units comprises:

a delay circuit for delaying the control signal and then outputting the delayed control signal to another one of the refreshing units.

10. The display device according to claim 3, wherein the column drive unit and the row drive unit respectively output a high level signal during a third interval, and the third interval is between the first interval and the second interval.

* * * * *